United States Patent [19]

Baruffa et al.

[11] Patent Number: 4,619,214

[45] Date of Patent: Oct. 28, 1986

[54] SEWING MACHINE WITH CAM-CONTROLLED NEEDLE BAR AND FEED DOG

[75] Inventors: Olindo Baruffa, Thonex; Antonio Jimenez, Meyrin, both of Switzerland

[73] Assignee: Mefina, S.A., Switzerland

[21] Appl. No.: 668,722

[22] PCT Filed: Feb. 3, 1984

[86] PCT No.: PCT/CH84/00015

§ 371 Date: Oct. 10, 1984

§ 102(e) Date: Oct. 10, 1984

[87] PCT Pub. No.: WO84/03110

PCT Pub. Date: Aug. 16, 1984

[30] Foreign Application Priority Data

Feb. 10, 1983 [CH] Switzerland ..... 737/83

[51] Int. Cl.[4] ..... D05B 3/02

[52] U.S. Cl. ..... 112/459; 112/315

[58] Field of Search ..... 112/158 R, 158 A, 158 D, 112/315, 459

[56] References Cited

U.S. PATENT DOCUMENTS

| | | | |
|---|---|---|---|
| 2,976,830 | 3/1961 | Vigonelli . | |
| 4,120,254 | 10/1978 | Herr et al. . | |
| 4,195,583 | 4/1980 | Matsumoto . | |
| 4,276,840 | 7/1981 | Takemoya et al. | 112/315 |
| 4,284,016 | 8/1981 | Matumura . | |
| 4,326,472 | 4/1982 | Yamashita et al. | 112/158 D |
| 4,327,654 | 5/1982 | Odermann et al. . | |
| 4,385,573 | 5/1983 | Brienza . | |

FOREIGN PATENT DOCUMENTS

| | | |
|---|---|---|
| 748857 | 4/1970 | Belgium . |
| 27867 | 8/1980 | European Pat. Off. . |
| 177846 | 12/1905 | Fed. Rep. of Germany . |
| 1760051 | 11/1971 | Fed. Rep. of Germany . |
| 2734404 | 2/1978 | Fed. Rep. of Germany . |
| 2368566 | 5/1978 | France . |
| 2085935 | 5/1982 | United Kingdom . |

*Primary Examiner*—Werner H. Schroeder
*Assistant Examiner*—Andrew M. Falik
*Attorney, Agent, or Firm*—Anthony A. O'Brien

[57] ABSTRACT

The lateral displacement or oscillation of a sewing machine needle bar is controlled by a permanently installed servomotor-driven cam operated in coordination with a second similarly installed servomotor-driven cam controlling the displacement of the fabric feed dog. Manipulation of the faces on the two cams, in a synchronized manner, allows numerous stitch patterns to be achieved according to the amplitude and direction of displacement of the needle bar and feed dog pursuant to the positioning of the faces on the two cams by their respective servomotors.

8 Claims, 16 Drawing Figures

SEWING MACHINE WITH CAM-CONTROLLED NEEDLE BAR AND FEED DOG

BACKGROUND OF THE INVENTION

The invention has as its object a sewing machine, comprising elements for lateral control and positioning of the needle holder bar and for the adjustment of the amplitude and the direction of the movement of the material to be sewn.

A sewing machine is known such as in Swiss Pat. No. 277,952 in which the lateral movements of the needle holder bar and the advance of the feed are controlled by two cams, fastened in a removable way on a drive shaft, in continuous movement, that can be replaced by other interchangeable cams.

By the present invention, an improved arrangement is presented wherein separate, multi-faced cams each controlled by an individual servomotor are located in the machine upper and lower frames and are regulated by suitable control means such as one or more microprocessors to respectively manipulate the lateral needle bar movement and feed dog movement. Additionally, the upper frame cam serves to immobilize the needle bar. In this manner, the two permanently installed cams may be operated in a plurality of coordinated modes to achieve numerous stitching patterns without the necessity of exchanging cam elements as in many prior known machines.

SUMMARY OF THE INVENTION

To automate, simplify and increase the sewing capabilities, the machine according to the invention is characterized in that, on the one hand, it comprises a first servomotor that drives at least two cam portions, or faces, the first face making it possible, by contact with a first feeler, to assure the lateral positioning of the needle holder bar, and the second face working with the first face against which a third feeler rests to assure the disengaging of the needle bar, while a second servomotor drives at least a cam face that determines, by contact with a fourth feeler, the amplitude of the forward movement or the backward movement of the material to be sewn.

BRIEF DESCRIPTION OF THE DRAWINGS

The accompanying drawings diagrammatically and by way of example show an embodiment of the machine according to the invention.

DESCRIPTION OF THE PREFERRED EMBODIMENT

Figure 1:
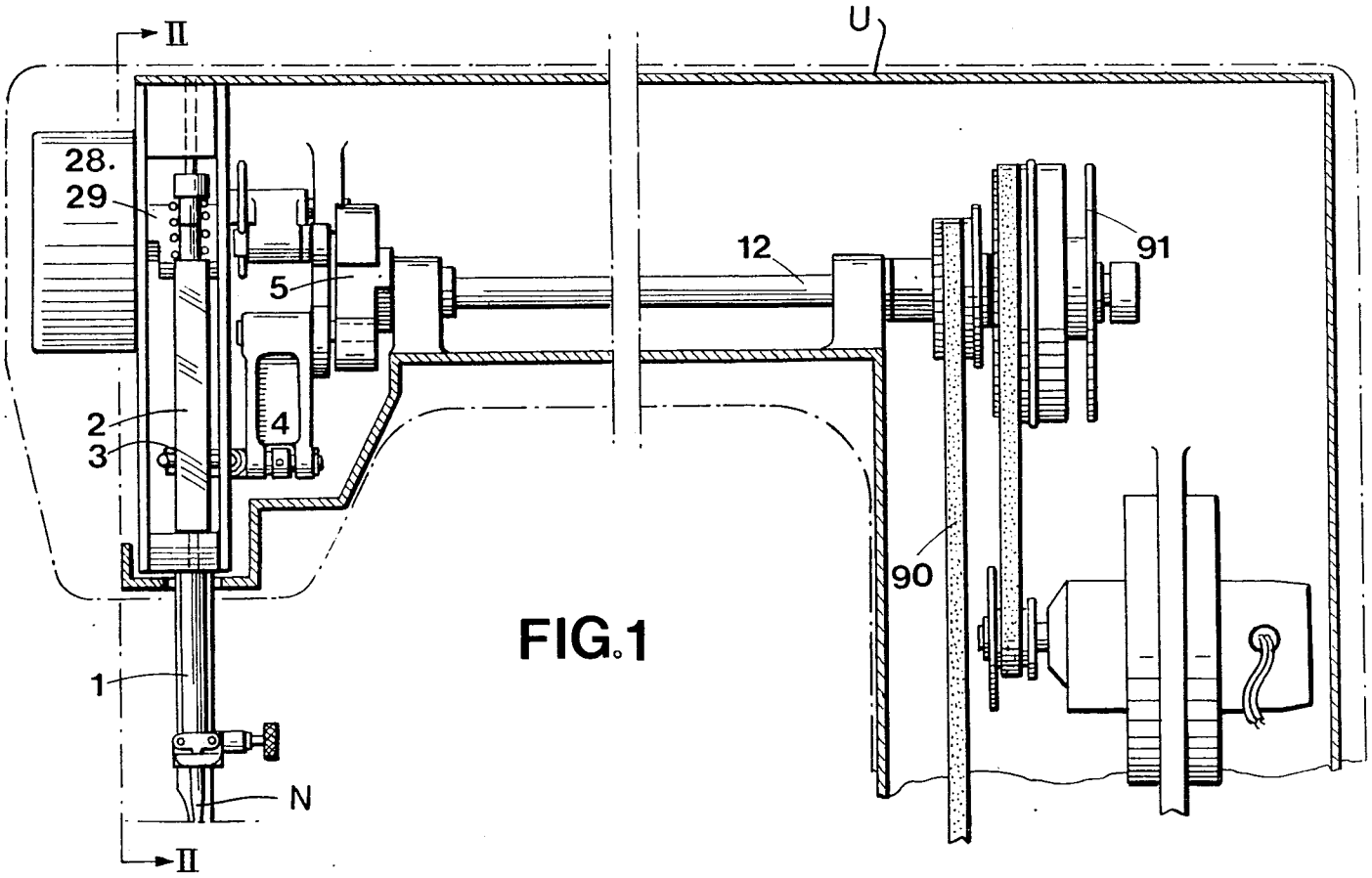
FIG. 1 is a partial view, showing the upper arm of the machine in front elevation with cutaways.
Figure 2:
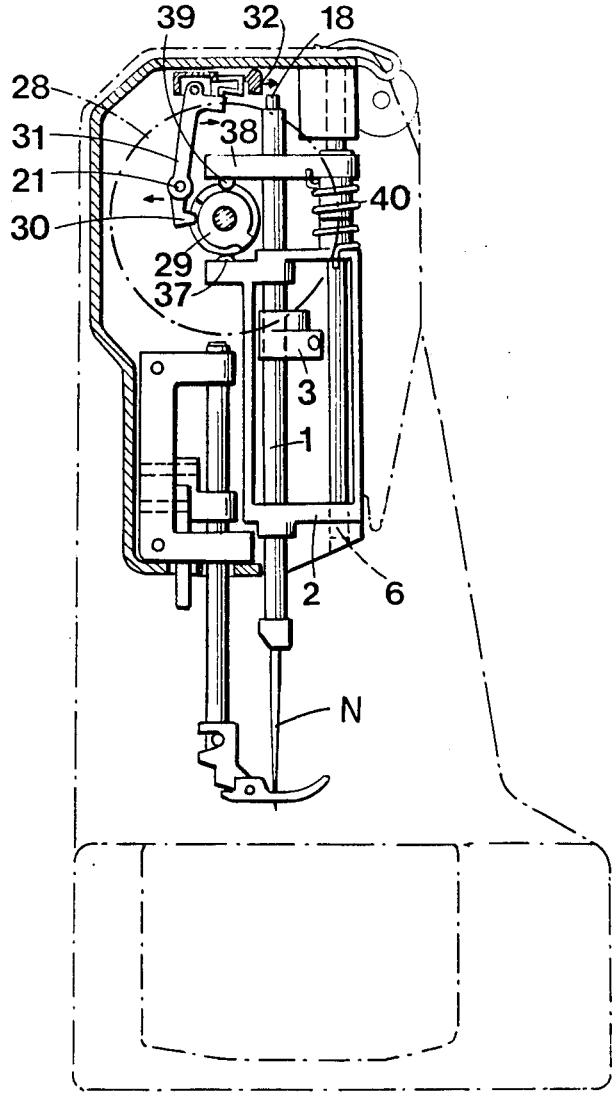
FIG. 2 is a partial view of it, showing the head of the machine in section along II—II of FIG. 1.

As shown in FIGS. 1 and 2 of the drawings, the sewing machine comprises an upper arm or frame U with a tubular needle bar 1, mounted to slide in a swivelling cradle 2, the longitudinal reciprocating movement of needle bar 1 being assured by a journal 3, connected to a connecting rod 4 and driven by an eccentric plate 5 mounted on main drive shaft 12 of the machine.

Figure 5:
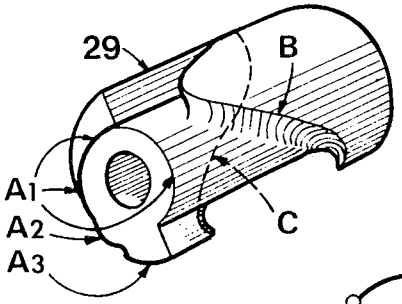
FIG. 5 is a view in perspective of the control cam, shown in FIGS. 1 and 2.
Figure 6:
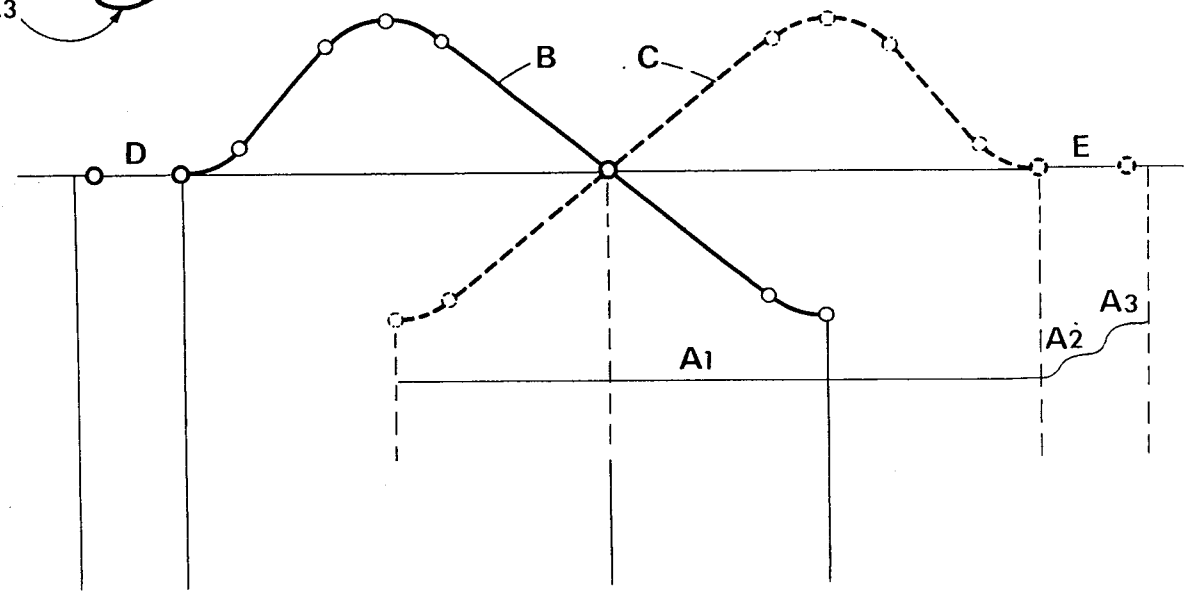
FIG. 6 is a diagram of the functions of the cam, shown in FIG. 5.

As shown in FIGS. 5 and 6, a first cam 29 comprises two laterally presented faces B and C for controlling zig-zag sewing. To do this, cam 29 is subjected to an alternating oscillating movement of determined amplitude by a first servomotor 28 as depicted in FIGS. 1 and 2. In straight sewing, the lateral positioning of a needle N attached to needle bar 1 is also controlled by the angular position of cam 29, determined by servomotor 28. This automatic control makes it possible to obtain infinite variations of the width of the stitch, or of the lateral positioning of the needle bar.

As shown in FIGS. 2 and 6, the control of the crosswise movement of needle bar 1 is assured by face C of cam 29, against which a feeler 37 solid with the upper end of cradle 2 rests. Cam face B is engaged by another feeler 39 mounted on a lever arm 38 in turn mounted to pivot on oscillation shaft 6 of cradle 2. Feelers 37 and 39 are kept in contact with cam faces B, C by a counterspring 40.

Figure 3:
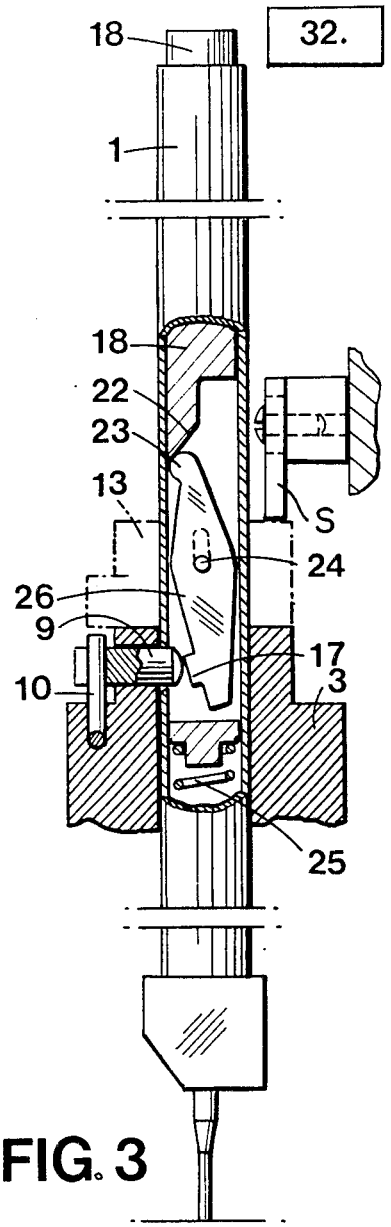
FIG. 3 is a view in larger scale, partially in axial section, of the needle bar, shown in FIG. 2.
Figure 4:
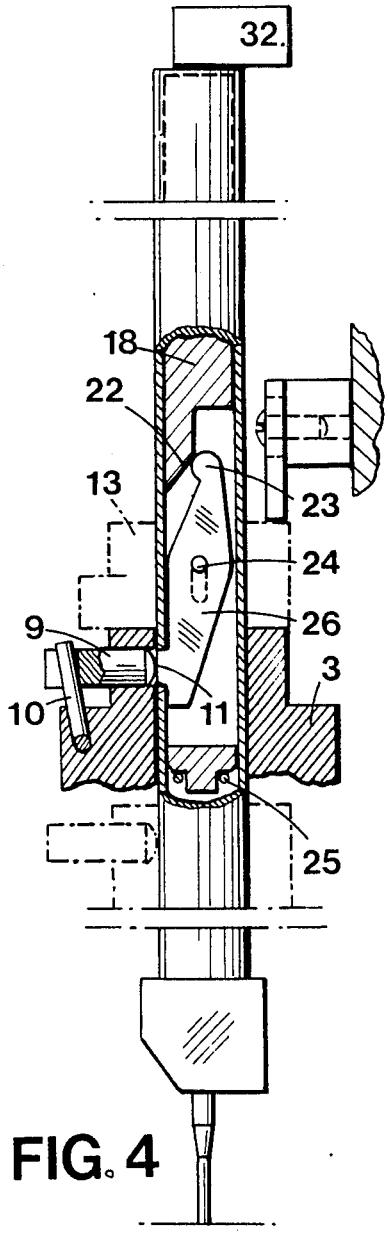
FIG. 4 is a view similar to FIG. 3, showing the needle bar in the disengaged position.

As shown in FIGS. 3 and 4, a control element 26 for disengaging needle bar 1 is mounted to pivot on a transverse shaft 24 inside the tubular needle bar 1. A rod 18 inside the bar 1 exhibits a ramp 22, which, when it is inserted, against the action of a return spring 25, between the inner wall of needle bar 1 and the head 23 of the pivotal control element 26, causes it to pivot on shaft 24. Because of this, plug 17 of control element 26 pushes lug 9 outside of an opening 11 in the bar 1, against the action of spring 10. Consequently, journal 3 slides on needle bar 1, which remains in high position under the action of a spring, with a needle bar locking ring 13 being held by a stop S.

As shown in FIGS. 5 and 6, cam 29 comprises a third face or ramp $A_1$, $A_2$, $A_3$, against which a feeler 30 of a lever 31 rests. The feeler is hinged on a shaft as at 21 in FIG. 2.

When servomotor 28 drives cam 29, shown in FIG. 2, in a clockwise direction, feeler 30 resting on the ramp at $A_1$ will go on to $A_3$ and pivoting lever 31 will urge the attached support element 32 into position for disengaging needle bar 1. This action occurs as the element 32 abuts the opposite free end of disengaging rod 18 being driven during the lifting of needle bar 1.

Figure 7:
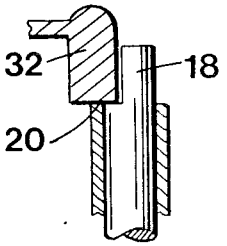
FIG. 7 shows a variant of the disengaging element of the needle bar.

The stop S for holding locking ring 13 can be advantageously replaced by support element 32, provided that the upper end of rod 18 (FIG. 7) exhibits a clearance 20, making it possible for support element 32 to hold needle bar 1 in engaged position, when feeler 30 rests against position $A_2$ of the third cam face.

The lateral position of needle bar 1 remains determined by the displacement of the feeler 37 by the cam faces B and C, as feeler 30 engages the third cam face portions $A_2$ or $A_3$. With the above description in mind, it will be seen that FIG. 6 depicts the lateral displacement of various points along the cam faces B and C relative to the radial displacement of points along the faces $A_1$, $A_2$ and $A_3$ during each revolution of cam 29 as reflected by the line D-E.

With additional faces, cam 29 could further assure other functions such as the adjustment of the tension of the thread, for example (not shown).

Quite obviously, the production of varied zig-zag stitching patterns requires a direct coordination between not only the lateral displacement of the needle bar but also the feed rate of the fabric being operated upon. With this in mind, it should be fully appreciated that the control of the movement of the machine feed dog 47 with respect to the needle bar operation, is quite important. In this regard, the present invention includes the provision of a second cam regulated by a second servomotor within the machine lower frame L together with appropriate displaceable means for regulating the movement of the associated feed dog.

As shown in FIGS. 8 to 12 another or second cam 83 within the lower frame or bed L is positioned angularly by another or second servomotor 70 to control the amplitude of the forward movement and backward movement of feed dog 47 integral with a feed dog support 46. This action is controlled by a feeler 63, solid with a lever 64 and in contact with face 62 of cam 83, this control being transmitted by lever 64, hinged to the frame. The resultant displacement is determined by links 65 and 66 and the angular position of a link 61, it being understood that links 66 and 61 are solid with the same shaft 67, hinged in the frame. The angular position of link 61 determines the direction and the amplitude of the movement of feed dog support 46 by way of links 57, 52, this latter being connected by a shaft 54 to an angular link 55, 56. The common shaft 53 of links 57, 52 is driven by an eccentric 50 and a connecting rod 51.

Figure 9:
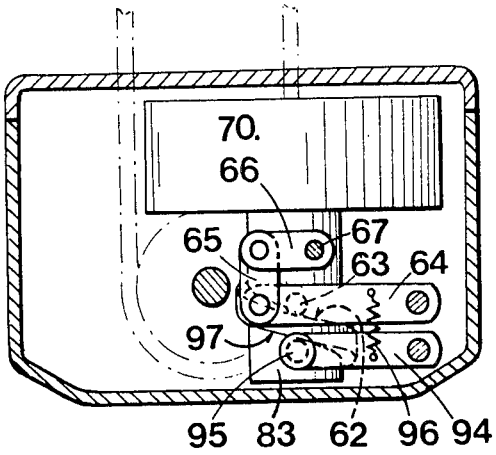
FIG. 9 is a view in cross section along IX—IX of FIG. 8.
Figure 10:
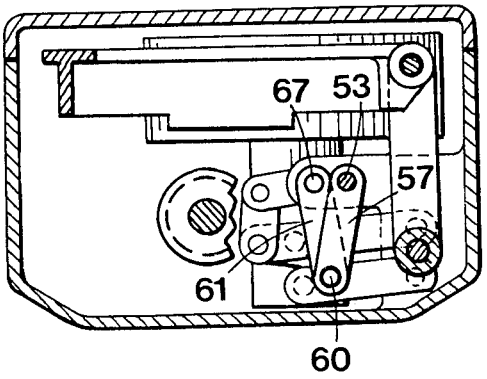
FIG. 10 is a view in cross section along X—X of FIG. 8.
Figure 11:
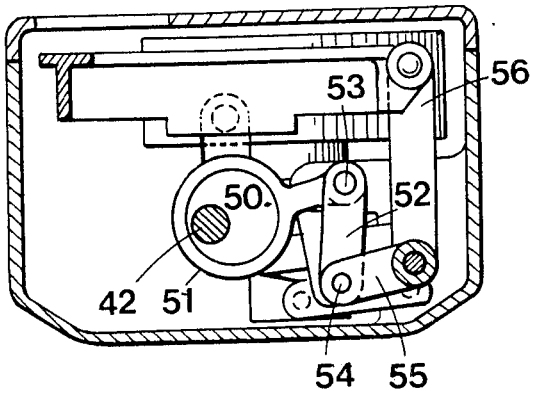
FIG. 11 is a view in cross section along XI—XI of FIG. 8.

As shown in FIG. 9, a lever 94 connected to the frame is equipped with a feeler 95 in contact with a cam 83 with a face 97, parallel to a face 62 and assures the contact of feeler 63 against face 62, under the action of a return spring 96 connecting lever 64 to lever 94, thus forming a parallelogram, constituting a device for taking up the play with an approximately constant torque.

Figure 8:
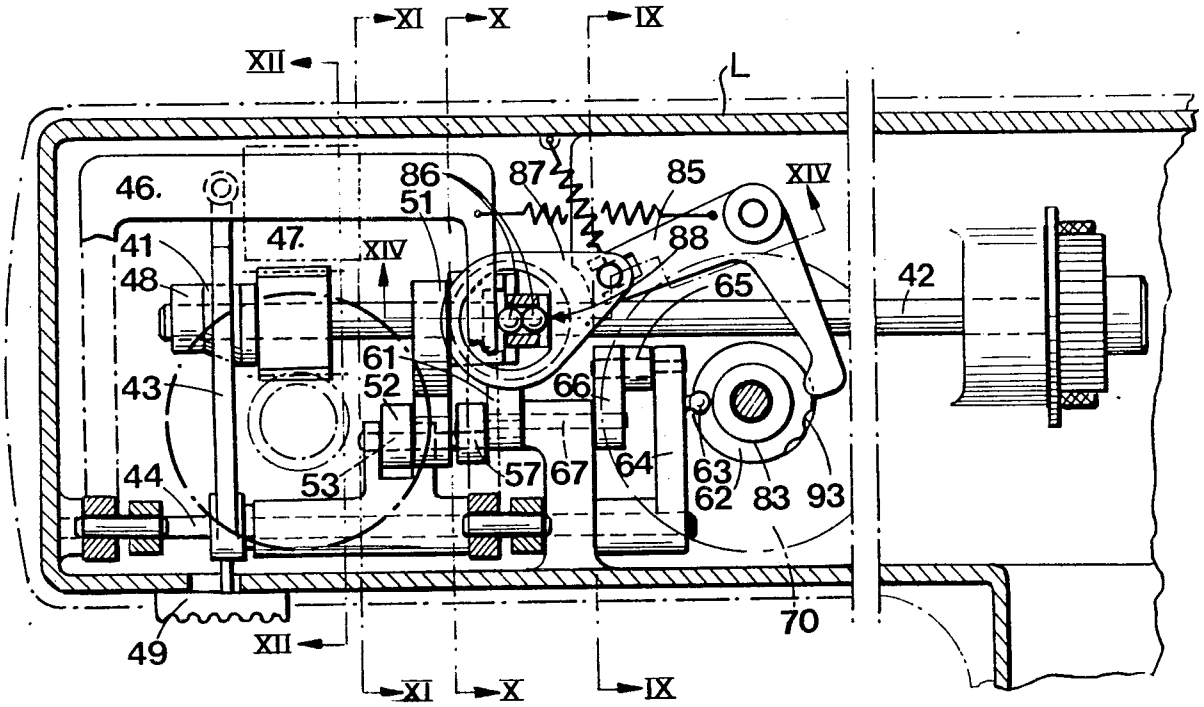
FIG. 8 is a partial top view with cutaway of the lower frame of the machine.
Figure 15:
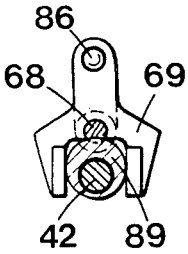
FIG. 15 is a view in section along XV—XV of FIG. 14.
Figure 14:
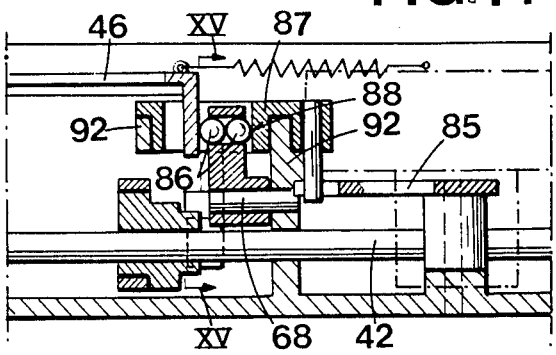
FIG. 14 is a view in section of it along XIV—XIV of FIG. 8.

As shown in FIGS. 8, 14 and 15, a second face 93 of cam 83 controls by a lever 85 the angular position of a part 87, hinged in a bearing 92 of the frame and angularly orients a plane or surface 88, solid with part 87, in relation to the standard sewing direction of feed dog 47, so as to produce a lateral movement of feed dog support 46, against the action of a return spring. This is due to the oscillation produced by eccentric 89 upon the fork 69 swivelling on a shaft 68. The fork 69 will be seen to include balls 86 placed between feed dog support 46 and plane 88.

Depending on the orientation of plane 88, the lateral movement of feed dog support 46 is performed perpendicularly to the standard sewing direction in one direction or the other (left or right, see FIG. 8).

Alternately, plane 88 could oscillate with part 87 in bearing 92 of the frame by an eccentric, the amplitude and the direction of lateral movement of feed dog support 46 being determined by the position of balls 86 along plane 88.

Figure 12:
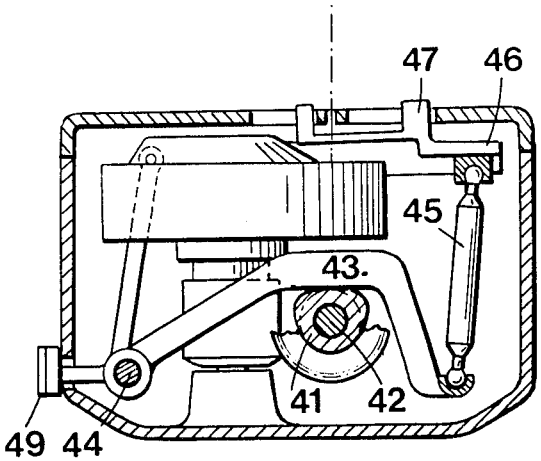
FIG. 12 is a view in cross section along XII—XII of FIG. 8.
Figure 13:
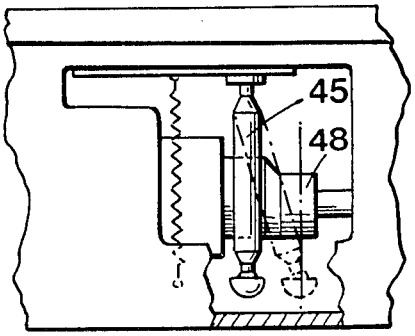
FIG. 13 is an exploded view, seen from right to left, of FIG. 12.

As shown in FIGS. 12 and 13, feed dog support 46 rests on a ball-and-socket support connecting rod 45, to allow both lengthwise and crosswise movement or simultaneous lengthwise and crosswise movement of feed dog support 46.

As shown in FIGS. 8 and 12, an eccentric cam 41 solid with lower shaft 42 of the machine drives a lever 43 hinged on a shaft 44, solid with the lower frame, to assure the lifting of the feed dog support 46 by ball-and-socket support connecting rod 45. By moving lever 43 to the left of FIG. 8, on shaft 44 by manual pusher or selector 49, lever 43 comes to rest on a cylindrical element 48. An interruption of the feeding of the fabric by feed dog 47 results because there is no longer a lifting of the feed dog, this feed dog remaining below the sewing plane, as a result of the retraction of the ball-and-socket support connecting rod 45 (see FIG. 13).

The movement of lever 43 for putting feed dog 47 in or out of operation could be assured by an additional face of cam 83.

Figure 16:
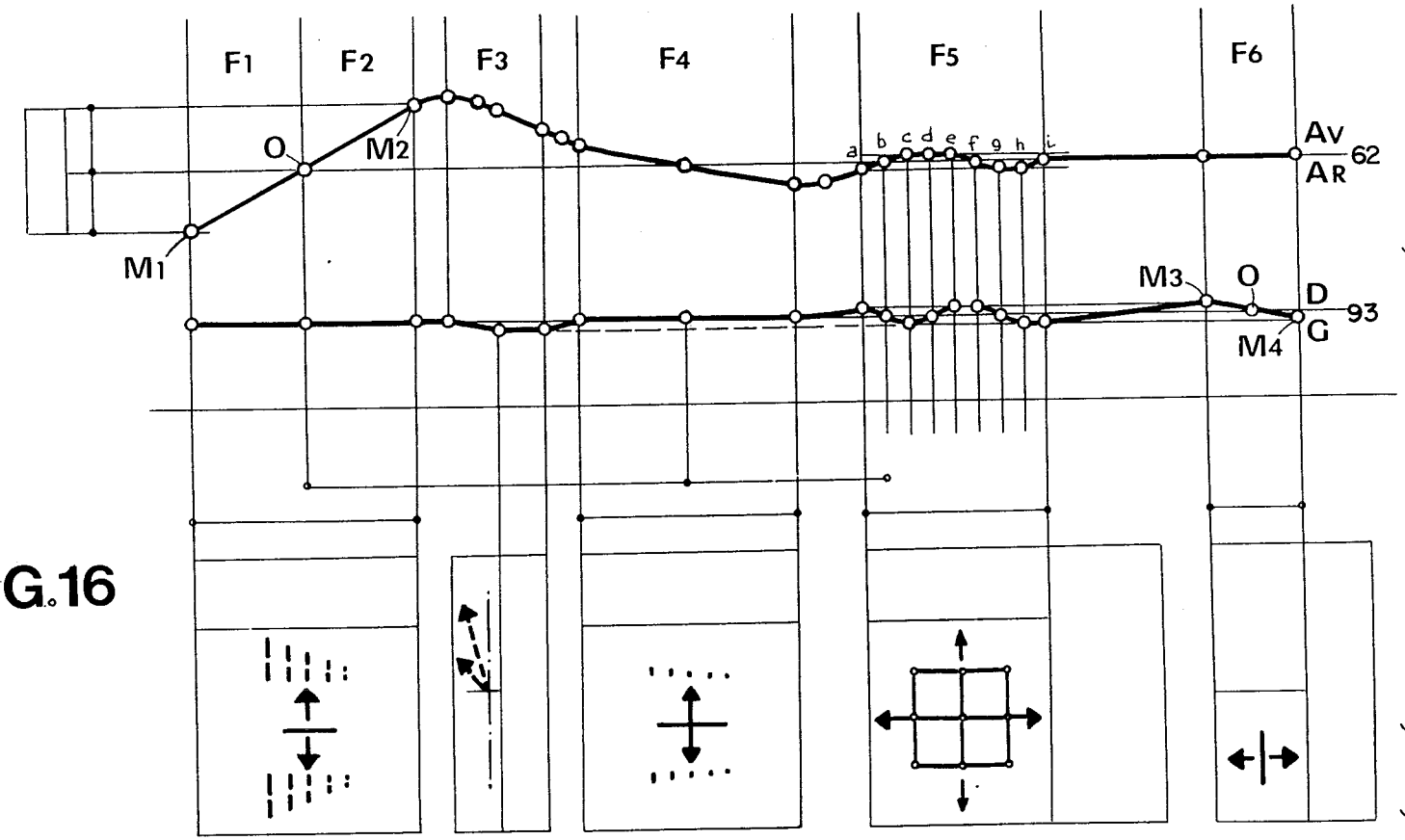
FIG. 16 is a diagram of the functions of the control cam, shown in FIGS. 8 and 9.

Several functions which can be assured by faces 62 and 93 of cam 83 have been diagrammatically represented, from left to right in FIG. 16, that can be made by the combination of the two directions of feed of the fabric, in relation to one another.

$F_1$ corresponds to the adjustment of the amplitude of the length of the stitch during the feed in reverse from 0 to the maximum $M_1$, face 93 of cam 83 keeping plane 88 parallel to the standard sewing direction.

$F_2$ corresponds to the forward movement adjustment of the length of stitch O at the maximum $M_2$, face 93 of cam 83 keeping plane 88 parallel to the standard sewing direction.

$F_3$ corresponds to a movement on the bias of forward movement sewing with variable stitch length combined with a lateral movement to the left with intervention of lever 85, driven by face 93 or cam 83.

$F_4$ corresponds to a forward-reverse fine adjustment zone, the slope of face 62 of cam 83 being reduced to make possible a more precise adjustment of small stitch lengths, for the same oscillation angle of cam 83 as in $F_1$ and $F_2$. This mode would apply for example, for the sewing of bourdon stitches, button holes, etc., with face 93 of cam 83 keeping plane 88 parallel to the standard sewing direction.

$F_5$ corresponds to a combination of forward-reverse and left-right feed, determined by face 62 of cam 83, working with lever 85, by contact with face 93 of cam 83, thus making possible the following combinations:

a: reverse feed+lateral feed to the right
b: no feed
c: forward feed+lateral feed to the left
d: forward feed only
e: foward feed+lateral feed to the right
f: lateral feed to the right only
g: reverse feed only
h: reverse feed+lateral feed to the left
i: lateral feed to the left only Consequently, depending on the angular position of cam 83, it is possible to make tack, linear, and multidirectional stitching.

$F_6$ corresponds to the adjustment of the amplitude of the lateral feed of a maximum $M_3$ to the right to a maximum $M_4$ to the left while passing by a position corresponding to a zero feed.

The synchronization of the various control elements is assured between main drive shaft 12 and a lower shaft 42 by belt 90 and under the control of a servodisk 91, mounted on one of these shafts. The servomotors can be managed by one or more microprocessors.

We claim:

1. In a sewing machine comprising elements for lateral control and positioning of a needle bar carried by an oscillating cradle and for the adjustment of the amplitude and the direction of displacement of a feed dog for the movement of the material to be sewn, the improvement comprising, an upper arm containing a first servomotor driving a cam having a plurality of cam faces, a first said cam face engageable with a first feeler attached to said needle bar cradle to direct lateral positioning of the needle bar, a second said cam face cooperating with said first said cam face and engageable by another feeler, said another feeler connected to a support element and shiftable to a position for disengaging said needle bar, a lower frame containing a second servomotor driving a second cam having a cam face, still another feeler engaging said face of said second cam, and pivoted means connecting said still another feeler to the feed dog to regulate the amplitude of the forward-/backward movement of the material to be sewn.

2. A sewing machine according to claim 1, wherein said second servomotor simultaneously drives at least a second cam face on said second cam, and a lever contacting said second cam second face to control the lateral movement of the material to be sewn.

3. A sewing machine according to claim 1 including, a third face on said first cam parallel to said first cam face thereon, and an additional feeler spring-urged into contact with said third face to assure contact of said first feeler with said first face.

4. A sewing machine according to claim 1 wherein, said first feeler is integral with the oscillating cradle in which said needle bar is engaged.

5. A sewing machine according to claim 1 including, a lever hinged within said lower frame and having a further feeler in contact with an additional face on said second cam parallel to said face of said second cam, said still another feeler integral with a second lever and engaging said face of said second cam, said two levers connected to one another by a return spring so that said further feeler is urged to engage said additional face.

6. A sewing machine according to claim 1 including, a lever in said lower frame engaging one other face of said second cam, a part pivotally mounted in a bearing and angularly oriented by said lever so as to angularly orient a plane portion of said part in relation to the standard sewing direction of said feed dog, an eccentric pivoting on a shaft causing the oscillation of a fork, said feed dog having a support, said fork including a support element between said feed dog support and said plane portion of said part whereby, the amplitude and the direction of the lateral movement of said feed dog support is modified as a function of the orientation of said plane portion of said part.

7. A sewing machine according to claim 6 including, an additional lever in said lower frame, a connecting rod between said additional lever and feed dog support having at each of its ends a ball-and socket to provide a multidirectional movement of said feed dog support and the retraction of said feed dog.

8. A sewing machine according to claim 7 including, a lower frame drive shaft, an eccentric cam fixed to said lower frame drive shaft and engaging said additional lever to activate said connecting rod, and a manual pusher operable to disengage said additional lever from said eccentric cam to interrupt the feed of the fabric.

* * * * *